US007289025B2

(12) United States Patent
Perez-Garcia et al.

(10) Patent No.: US 7,289,025 B2
(45) Date of Patent: Oct. 30, 2007

(54) METHOD AND SYSTEM FOR SECURING AN ELECTRONIC DEVICE

(75) Inventors: Fernando Perez-Garcia, Madrid (ES); Georges Seuron, Vence (FR)

(73) Assignee: International Business Machines Corporation, Armonk, NY (US)

( * ) Notice: Subject to any disclaimer, the term of this patent is extended or adjusted under 35 U.S.C. 154(b) by 221 days.

(21) Appl. No.: 11/014,309

(22) Filed: Dec. 16, 2004

(65) Prior Publication Data

US 2005/0134431 A1 Jun. 23, 2005

(30) Foreign Application Priority Data

Dec. 19, 2003 (EP) ..... 03368118

(51) Int. Cl.
*G08B 13/14* (2006.01)

(52) U.S. Cl. ..... 340/571; 340/568.1; 340/5.74; 340/825.49; 340/7.2; 340/539.23

(58) Field of Classification Search ..... 340/572.1, 340/539.11, 539.23, 568.1, 571, 5.1, 5.21, 340/7.2, 825.49, 5.74
See application file for complete search history.

(56) References Cited

U.S. PATENT DOCUMENTS

| | | | | |
|---|---|---|---|---|
| 5,402,104 | A * | 3/1995 | LaRosa | 340/539.23 |
| 6,333,684 | B1 * | 12/2001 | Kang | 340/7.2 |
| 6,472,986 | B1 * | 10/2002 | Sorriaux | 340/571 |
| 6,504,480 | B1 * | 1/2003 | Magnuson et al. | 340/571 |
| 6,614,350 | B1 * | 9/2003 | Lunsford et al. | 340/572.1 |
| 7,009,512 | B2 * | 3/2006 | Cordoba | 340/539.23 |

FOREIGN PATENT DOCUMENTS

WO WO 03/009620 A1 1/2003

* cited by examiner

*Primary Examiner*—Anh V. La
(74) *Attorney, Agent, or Firm*—Joseph Petrokaitis; John R. Pivnichny

(57) ABSTRACT

A security control system secures electronic devices. The electronic devices communicate wirelessly with the security control system. The security control system can be used to define an authorized wireless communication area for the electronic devices. On a regular basis, the security control system checks the presence of the electronic devices within the authorized wireless communication area. If an electronic device is removed from wireless communication without a deconnection request, an alarm is sounded.

13 Claims, 7 Drawing Sheets

METHOD AND SYSTEM FOR SECURING AN ELECTRONIC DEVICE

TECHNICAL FIELD

The present invention relates to security of electronic devices in general and more particularly to a system and method to prevent wireless electronic devices from being stolen.

BACKGROUND OF THE INVENTION

The recent proliferation of personal electronic devices such as mobile telephones, pagers, personal data assistants (PDAs), and laptop computers has been accompanied by an increase in the theft of these devices. This increase has led to the development of security systems designed to prevent the theft of these devices. Presently available security systems for laptop computers typically rely on a physical restraint, such as a cable or locking case, to prevent removal of a laptop computer from a surface to which the laptop computer is attached. In many situations, it is difficult to find a safe and easy place to fasten the cable. Some surprising configurations may be encountered, such as having a laptop computer attached to a drawer of a desk and the like.

Other kinds of security systems such as passwords, PIN codes or a mix of both may be used for mobile telephones, pagers or personal data assistants.

It would be desirable to provide a unique security system and method that encompasses all types of electronic devices, while overcoming the deficiencies of the conventional technologies as discussed above.

SUMMARY OF THE INVENTION

Accordingly, the main object of the invention is to provide a method and system to prevent the removal of wireless personal computers or personal devices from a security area without permission. Such method enables a wireless compatible security controller to be automatically warned if anyone attempts to remove a personal computer or any device from a wireless communication coverage area. The invention is particularly suitable with devices being Bluetooth technology compliant.

This and other objects are attained in accordance with one embodiment of the present invention wherein there is provided a method for securing an electronic device having first wireless communication means to communicate with a security control device, the security control device having second wireless communication means to define a wireless communication area, the method comprising the steps of creating a control information shared between the electronic device and the security control device, checking for the presence of the electronic device within the wireless communication area by using the control information during a wireless communication between the first and the second wireless communication means, and launching an alarm process if no control information is received by the security control device during the checking step.

In accordance with another embodiment of the invention there is provided a security system for securing an electronic device having first wireless communication means to communicate with a security control device, the security control device having second wireless communication means to define a wireless communication area, the security system comprising means for creating a control information shared between the electronic device and the security control device, means for checking for the presence of the electronic device within the wireless communication area by using the control information during a wireless communication between the first and the second wireless communication means, and means for launching an alarm process if no control information is received by the security control device during the checking.

In accordance with another embodiment of the invention there is provided a computer program product to secure an electronic device having first wireless communication means to communicate with a security control device, the security control device having second wireless communication means to define a wireless communication area, the computer program product comprising a computer readable medium, first program instructions to create a control information shared between the electronic device and the security control device, second program instructions for checking for the presence of the electronic device within the wireless communication area by using the control information during a wireless communication between the first and second wireless communication means, and third program instructions to launch an alarm process if no control information is received by the security control device during the checking, and wherein the first, second and third instructions are recorded on the medium.

DETAILED DESCRIPTION OF THE INVENTION

For a better understanding of the present invention, together with other and further objects, advantages and capabilities thereof, reference is made to the following disclosure and appended claims in connection with the above-described drawings.

Figure 1:
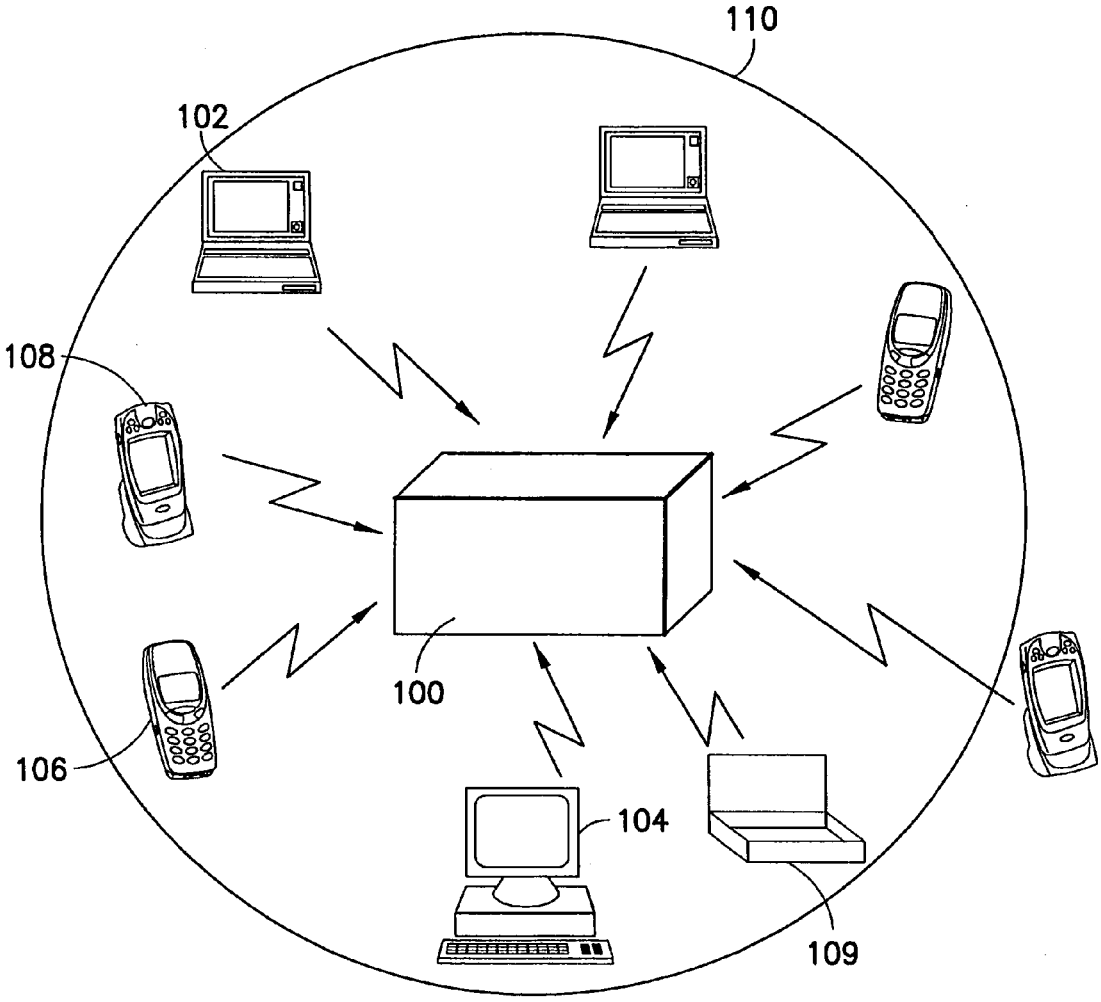
FIG. 1 is a view of a general environment where the invention may be used.

FIG. 1 illustrates a view of a general Bluetooth environment where the invention may be used. A security system 100 controls a plurality of electronic (102, 104, 106, 108) or non-electronic devices 109 within a communication coverage area 110. Security system 100 is Bluetooth compliant. The electronic devices may be portable computers 102, desktop computers 104, mobile telephones 106 or PDAs 108 and the like. Non-electronic devices may be jewel box 109 having a wireless interface and the like. Coverage area 110 is defined by wireless communication technology implemented in a security control device 200.

Security system 100 makes use of Bluetooth wireless communication technology. However, the wireless communication interface used by the present invention may be any interface card that enables a low power, radio technology wireless communication.

As those skilled in the art know, Bluetooth is an established standard for short-range wireless communication that enables compatible electronic devices to wirelessly communicate in the 2.4 GHz ISM frequency band. Bluetooth is a trademark of Bluetooth SIG, Incorporated. A complete description of the Bluetooth technology may be found in Bluetooth Core Specification V1.2 available from Bluetooth SIG, Inc. of Overland Park, Kans.

Bluetooth allows devices such as mobile phones, headsets, PDA's and portable computers to communicate and send data to each other without the need for wires or cables to link the devices together, as long as the devices implement the same profile with complementary roles. Bluetooth has been specifically designed as a low cost, low power radio technology. Bluetooth is particularly suited to short range Personal Area Network (PAN) applications.

The main features of Bluetooth are that it is a real-time data transfer that enables the simultaneous communication between one master device and several slave devices with a coverage area of several square meters depending on the emitted power level and conditions. A close proximity of devices is not required since Bluetooth does not suffer from interference from obstacles such as walls. Bluetooth supports both point-to-point wireless connections without cables between mobile phones and personal computers and many other device types, as well as point-to-multipoint connections to enable ad hoc local wireless networks.

In order to be Bluetooth qualified, an electronic device must conform to a set of specifications, including those related to the profiles implemented.

Figure 2:
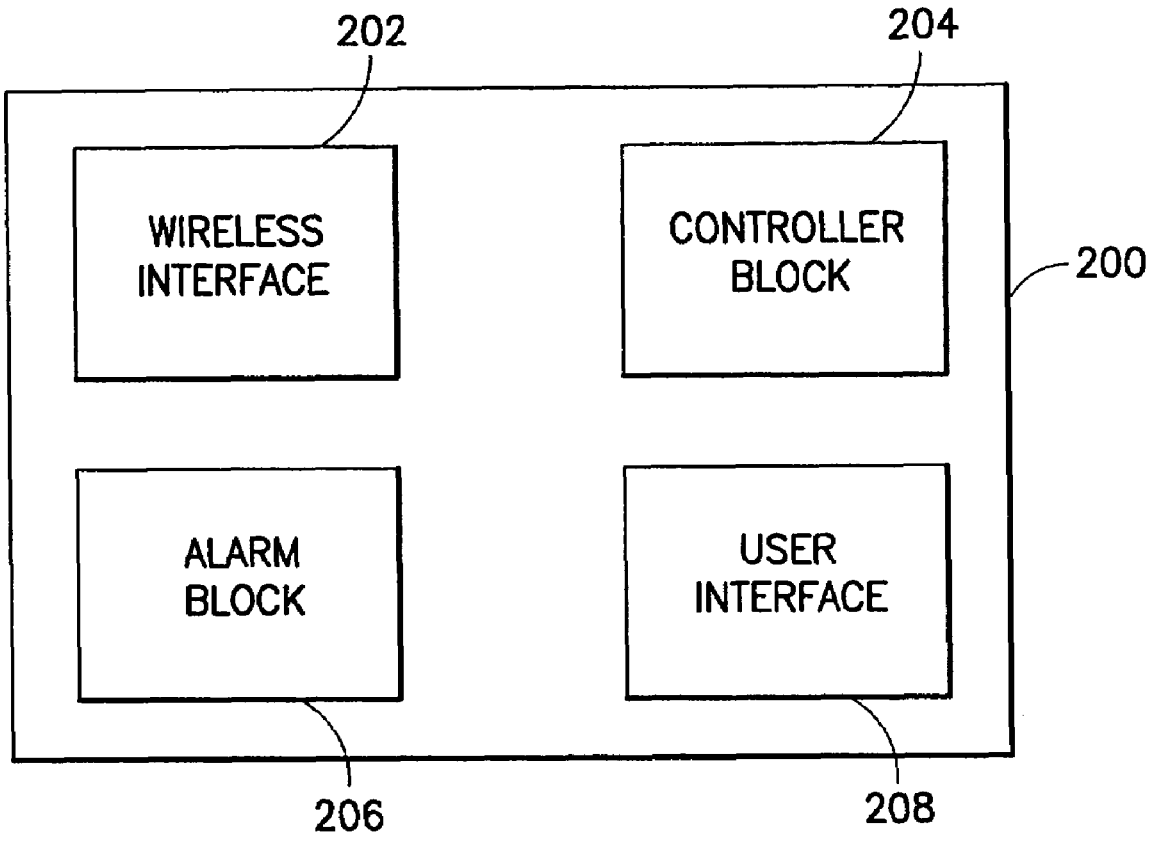
FIG. 2 is a block diagram of a security control device according to one embodiment of the invention.

Referring to FIG. 2, security control device 200 includes a wireless interface 202 that can be used to define a wireless communication area 110 to communicate with the device to be controlled, a control block 204 that can perform presence checking operations of the devices that have entered into wireless communication with security control device 200, and an alarm block 206 that launches an alarm when a controlled device leaves the wireless communication area 110 without a deconnection request. Security control device 200 may further include a user interface 208 in the form of a display screen or a keyboard to allow user operations.

Security system 100 may be either a black box that includes only the control components to operate the security control function of the present invention. It may also be a computer or a PDA that includes, as part of the computer or the PDA, standard control components to operate the security control function of the present invention.

Figure 3:
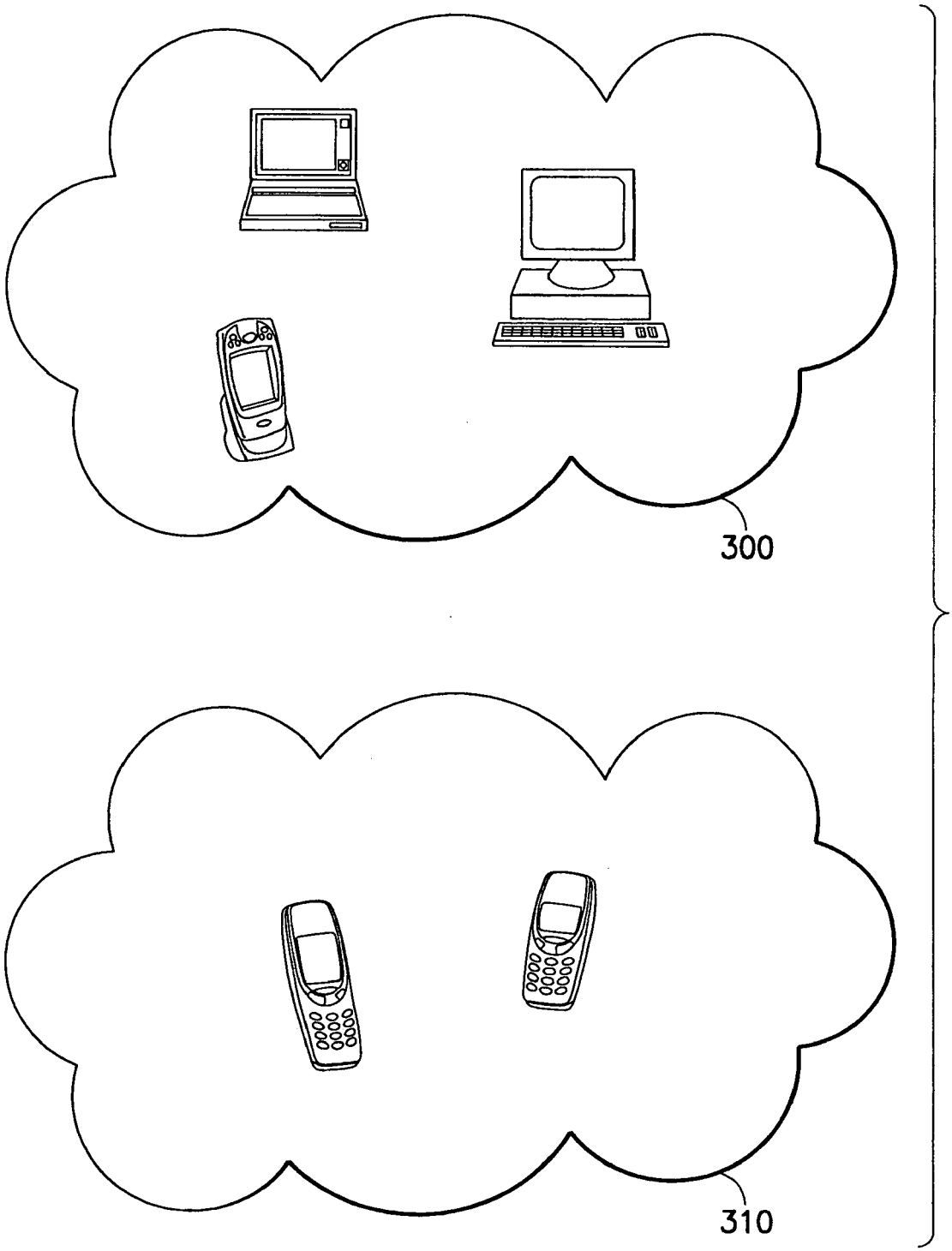
FIG. 3 illustrates some of the electronic devices controllable by the security system of the invention.

Referring to FIG. 3, security control device 200 can be used to control groups of intelligent 300 and simple 310 devices currently available today with Bluetooth technology.

Intelligent device group 300 includes devices having both the capability to execute Bluetooth functions and to implment additional software functions in a user friendly way to communicate with security control device 200.

Simple device group 310 includes devices having mainly the capability to execute standard Bluetooth functions, such as "Paging" or "Inquiry".

In normal operation, security control device 200 first discovers a device that enters into a Bluetooth connection within its coverage area 110 by issuing an "Inquiry" command.

Figure 4A:
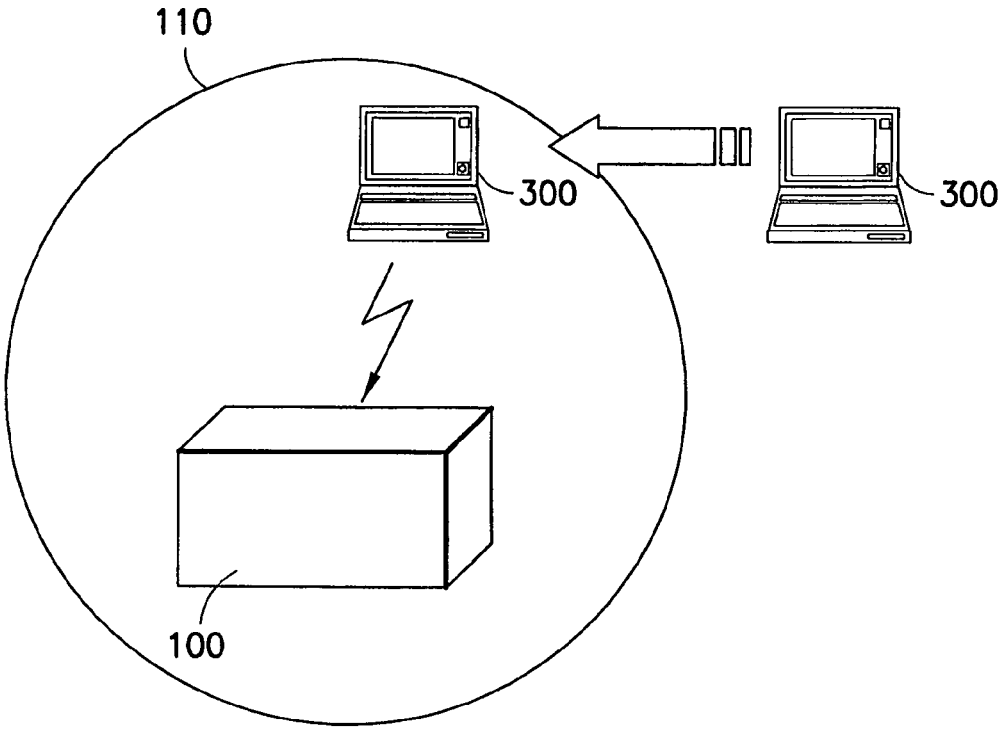
FIGS. 4*a*-4*b* illustrate creation of control information according to one embodiment of the invention.
Figure 5:
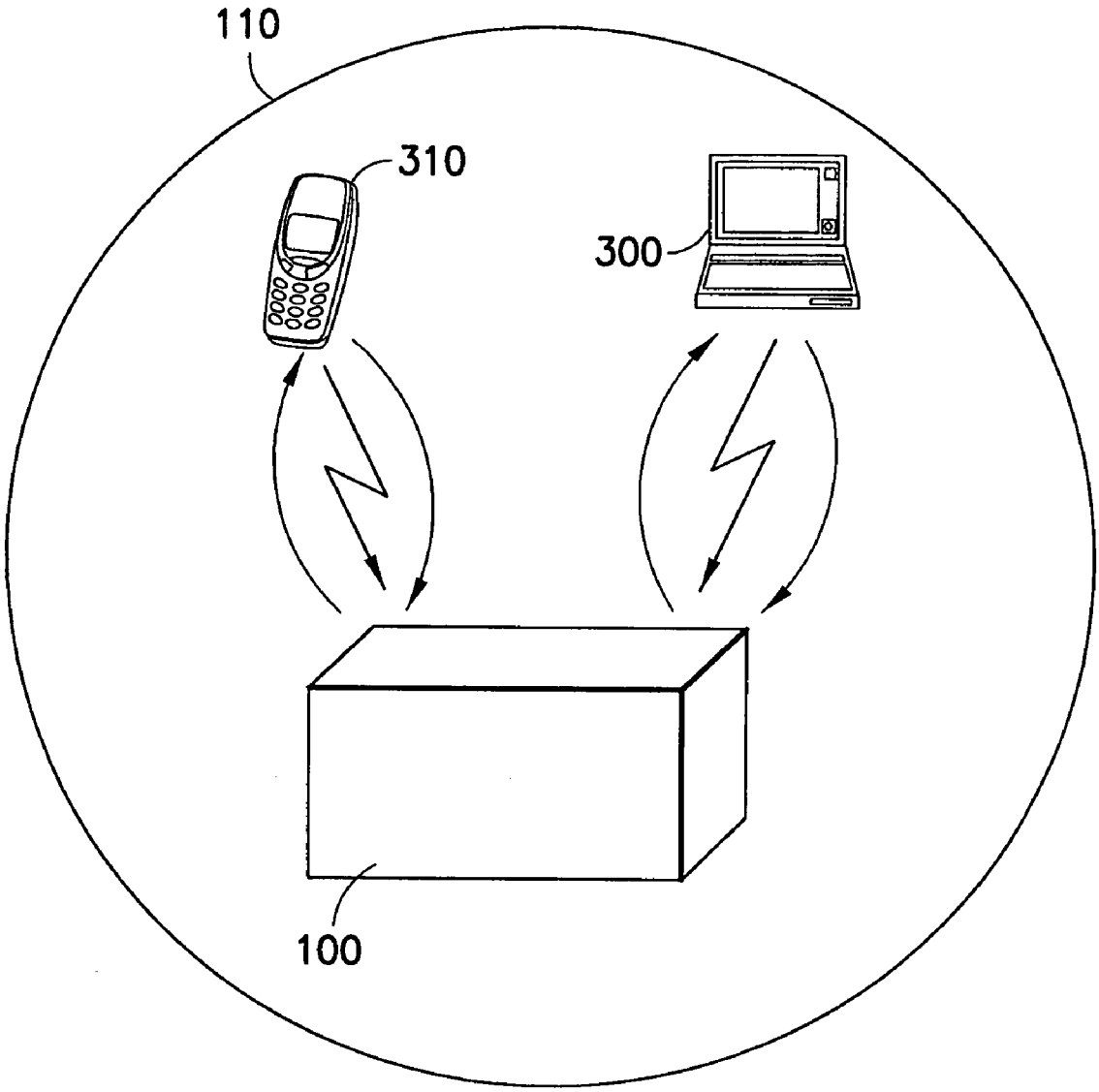
FIG. 5 illustrates presence checking of electronic devices within a wireless communication area according to one embodiment of the invention.

Referring to FIG. 4*a*, when an intelligent device 300 enters coverage area 110, security control device 200 detects its presence by the "Inquiry" Bluetooth function as shown in FIG. 5. Security control device 200 then offers intelligent device 300 an opportunity to attach to the security network by issuing a specific invitation message. This part of the communication is implemented in the previously cited additional software of this invention.

If intelligent device 300 accepts the invitation to attach to coverage area 110, a response is issued. The response includes a control identifier, preferably in the form of a user password to be assigned to the communication link between security control device 200 and the controlled intelligent device 300. The user password is declared by the owner of the controlled intelligent device 300. The user password is then respectively stored in a memory location of security control device 200 and the controlled intelligent device 300. A password is used at this stage as an electronic padlock that allows only the owner of the password to "open the padlock" to detach intelligent device 300 from coverage area 110. To ensure a higher security level, preferably the password is transmitted encrypted.

Figure 4B:
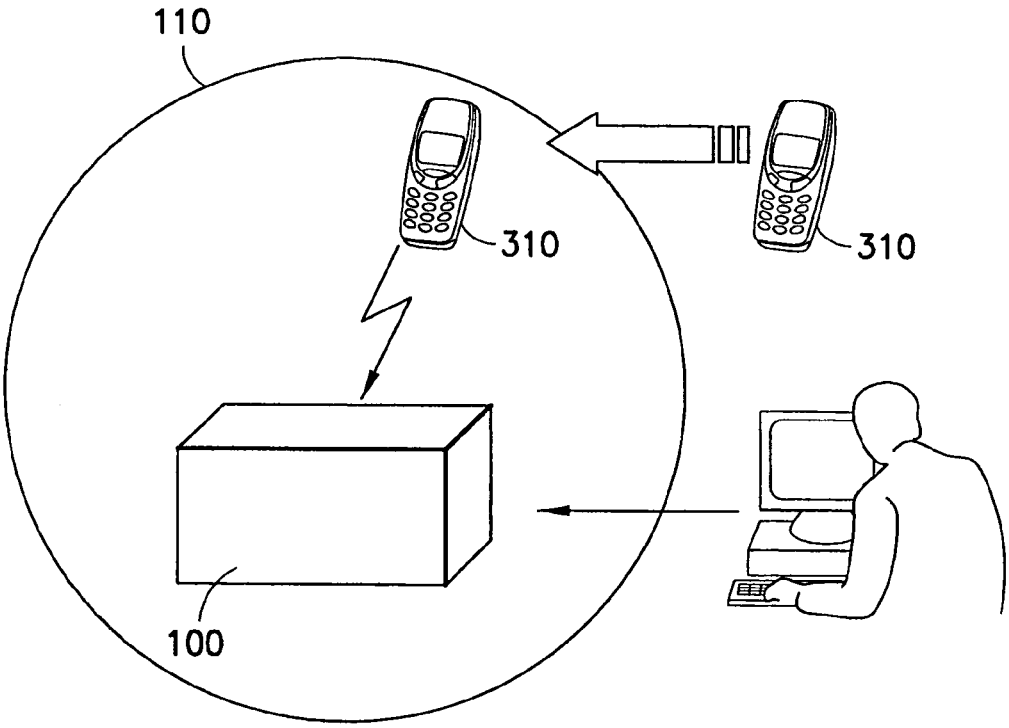

Referring to FIG. 4*b*, when a simple device 310 enters coverage area 110, it is not possible to execute any other functions except the standard Paging and Inquiry Bluetooth functions. All operations are then executed from security control device 200. All communications exchange will be based on those standard Bluetooth functions.

Referring to FIG. 5, security control device 200 detects the presence of the arriving controlled simple device 310 or intelligent device 300 by the Inquiry Bluetooth function. The user of the controlled simple device 300 then must start a session to assign a password to this communication link from security control device 200. Alternatively, a password may be automatically assigned to the controlled simple device 310 and sent to it. The password is then stored in a memory location of security control device 200. When the owner of the controlled simple device 310 needs to stop the Inquiry process with its controlled simple device 310, the password is entered and checked against the stored password in order to not start an alarm process.

Figure 6:
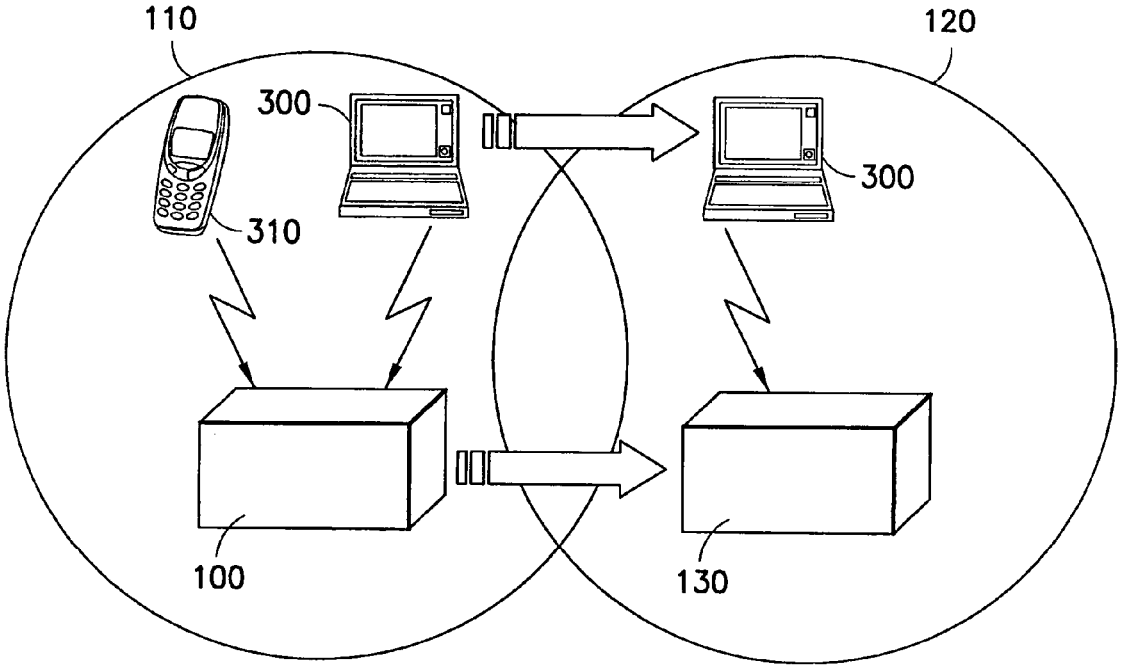
FIG. 6 illustrates a device translation from a first wireless communication area to a second one according to one embodiment of the invention.

Referring to FIG. 6, in an alternative embodiment with several security systems (100, 130) where several security control devices each control an overlapping coverage area (110, 120), the previously described process includes an initial step. When an intelligent device 300 is entering a coverage area (110, 120), the respective security control device of the coverage area (110, 120) fist requests the neighboring security control device if this intelligent device 300 is already known by at least one of them, by requesting the 'BD_ADDR' address of the intelligent device 300.

If at least one security control device has already registered intelligent device 300 it is a device translation. The device identification is directly sent to the requesting security control device. The requesting security control device then becomes the active security control device for that controlled intelligent device 300.

If the entering intelligent device 300 or simple device 310 is not already registered by any security control device, it is handled as a new entry and the identification process is executed, as previously explained, by assigning a password to either the intelligent device 300 or the simple device 310.

When a device is moving across the security area covered by a security control device, no specific alarm is raised unless the security control device does not receive answer to an Inquiry request.

In that case, the active security control device requests the neighboring security control devices to determine if any of them can reach the moving device. If a response is issued by at least one of the neighboring security control devices, then the situation is handled as a normal device and the responding security control device takes the active control of the moving device. The device identification is then transmitted to the new active security control device, preferably in an encrypted form. If no response is issued from the neighboring security control devices then the active security control device starts an alarm process. The alarm process may be either audible or visible or both audible and visible. Furthermore, an alert notice may also be issued and sent to a security office.

Figure 7A:
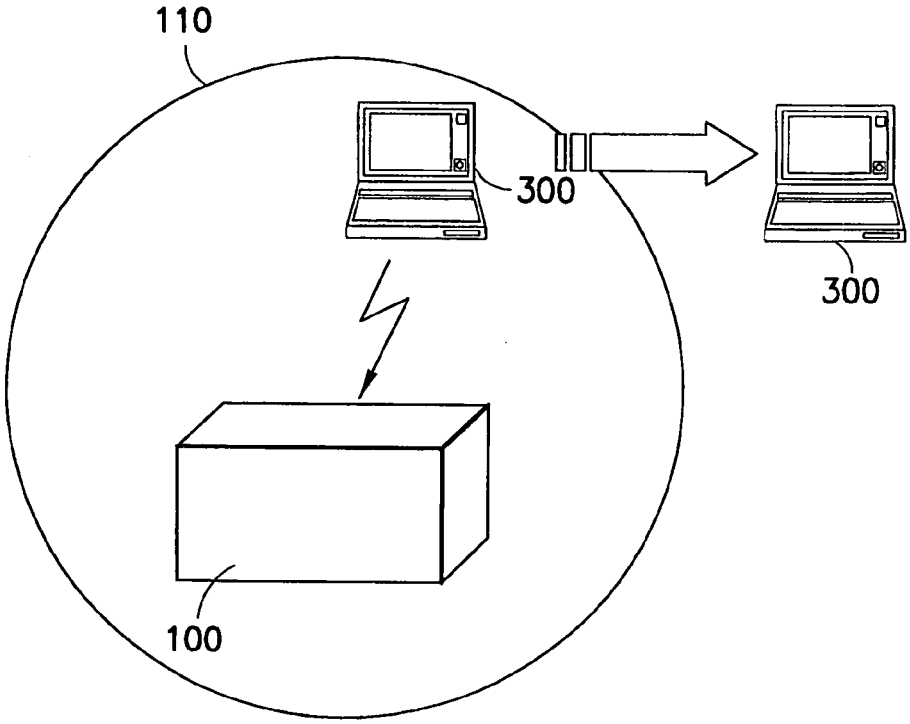
FIGS. 7*a*-7*b* illustrate a deconnection operation of a controlled device according to one embodiment of the invention.

Referring to FIG. 7*a*, when intelligent device 300 is to be detached from coverage area 110, a deconnection process is started from intelligent device 300. A deconnection request is sent to the active security control device. The active security control device asks for the identification password. The password is then sent back to the active security control device to be checked against the one stored in a memory location of the security control device. If a password match occurs the session is ended and the electronic padlock is opened.

Figure 7B:
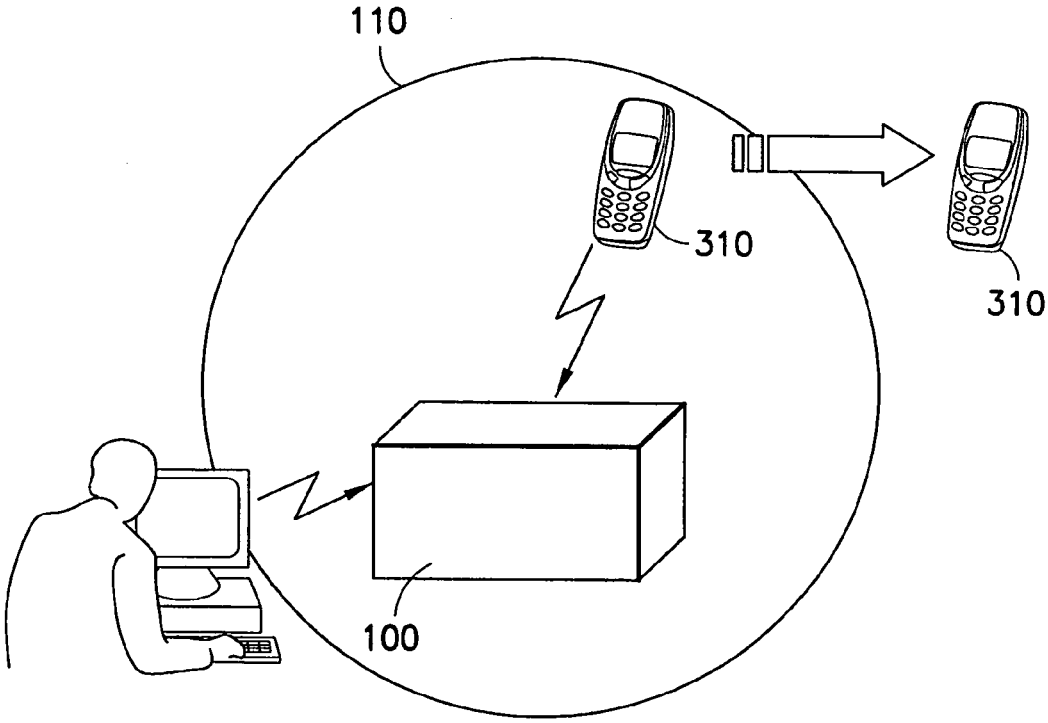

Referring to FIG. 7*b*, when a simple device 310 is to be detached from coverage area 110, a deconnection process is started from the active security control device. Simple device 310 is identified from a list of all the controlled devices inquired by the active security control device. The identification may be operated either by the user of the simple device 310 or by a user of the security control device to select simple device 310 from the list of controlled devices. When selected, a request is sent to the simple device 310 to send back the identification password. When received, the password is checked against the password stored in a memory location of the security control device for the respective simple device 310. If the password match occurs, the session is ended.

When a device of any of the groups of devices (300, 310) leaves coverage area 110 without a deconnection request, either because it is removed or because it is switched off, security control device launches the alarm process. If an intelligent device is removed from coverage area 110, the device alarm may also be launched.

While there have been shown and described what are at present considered the preferred embodiments of the invention, it will be obvious to those skilled in the art that various changes and modifications may be made therein without departing from the scope of the invention as defined by the appended claims.

The invention claimed is:

1. A method for securing an electronic device having first wireless communication means to communicate with a security control device, said security control device having second wireless communication means to define a wireless communication area, said method comprising the steps of:

determining an arrival of said electronic device within said wireless communication area before creating a control information shared between said electronic device and said security control device;

said security control device checking for the presence of said electronic device within said wireless communication area by using said control information during a wireless communication between said first and said second wireless communication means and said electronic device not checking for the presence of said security control device; and launching an alarm process if no control information is received by said security control device during said checking step.

2. The method according to claim 1 wherein said creating step includes a step of assigning a user password to said electronic device.

3. The method according to claim 1 wherein said checking step includes a step of requesting said electronic device to answer to said security device at regular time intervals.

4. The method according to claim 1 wherein said launching step includes a step of starting an audible or visible alert.

5. The method according to claim 1 further comprising a second security control device having third wireless communication means to define a second wireless communication area, wherein said method includes a step of said second security control device checking for the presence of said electronic device within said second wireless communication area before said launching step and said electronic device not checking for the presence of said second security control device.

6. The method according to claim 1 wherein said second wireless communication means is Bluetooth technology compliant.

7. The method according to claim 1 wherein said first and said second wireless communication means are Bluetooth technology compliant.

8. The method according to claim 6 wherein said checking step includes a step of issuing a Bluetooth Paging command to said electronic device at regular time intervals.

9. The method according to claim 1 where said determining step includes a step of issuing a Bluetooth Inquiry command.

10. The method according to claim 1 wherein said security control device is selected from the group consisting of mobile telephones, pagers, personal data assistants, laptop computers and personal computers.

11. The method according to claim 1 wherein said electronic device is selected from the group consisting of mobile telephones, pagers, personal data assistants, laptop computers and personal computers.

12. A security system for securing an electronic device having first wireless communication means to communicate with a security control device, said security control device having second wireless communication means to define a wireless communication area, said security system comprising:

means for determining an arrival of said electronic device within said wireless communication area before creating a control information shared between said electronic device and said security control device;

said security control device having means for checking for the presence of said electronic device within said wireless communication area by using said control information during a wireless communication between said first and said second wireless communication means and said electronic device not checking for the presence of said security control device and means for launching an alarm process if no control information is received by said security control device during said checking.

13. A computer program product to secure an electronic device having first wireless communication means to communicate with a security control device, said security control device having second wireless communication means to define a wireless communication area, said computer program product comprising:

a computer readable medium;

first program instructions to determine an arrival of said electronic device within said wireless communication area before creating a control information shared between said electronic device and said security control device;

second program instructions for said security control device for checking for the presence of said electronic device within said wireless communication area by using said control information during a wireless communication between said first and second wireless communication means and said electronic device not checking for the presence of said security control device; and third program instructions to launch an alarm process if no control information is received by said security control device during said checking and wherein said first, second and third instructions are recorded on said medium.

* * * * *